US006180902B1

(12) United States Patent
Kowalyshen et al.

(10) Patent No.: US 6,180,902 B1
(45) Date of Patent: Jan. 30, 2001

(54) FAULT INTERRUPTER AND OPERATING MECHANISM THEREFOR

(75) Inventors: Henry W. Kowalyshen, Niles; Chester H. Lin, Lincolnwood; John C. Opfer, Chicago, all of IL (US)

(73) Assignee: S&C Electric Company, Chicago, IL (US)

( * ) Notice: Under 35 U.S.C. 154(b), the term of this patent shall be extended for 0 days.

(21) Appl. No.: 08/994,720

(22) Filed: Dec. 19, 1997

(51) Int. Cl.[7] ..... H01H 33/02

(52) U.S. Cl. ..... 200/400; 218/7; 218/12; 218/154

(58) Field of Search ..... 200/17 R, 18, 200/400, 401, 424–426, 430, 50.32, 323–325, 50.37–50.39; 218/1, 2, 4–8, 10–14, 45, 55, 67, 78–80, 84, 92, 100, 120, 140, 152–154

(56) References Cited

U.S. PATENT DOCUMENTS 3,030,481 * 4/1962 Gussow et al. ..... 200/146
4,283,610 * 8/1981 Date et al. ..... 200/146 R
4,484,046 * 11/1984 Neuhouser ..... 200/144 B
5,075,521 * 12/1991 Rogers et al. ..... 200/148 F
5,504,293 * 4/1996 Rogers et al. ..... 218/154
5,772,009 * 6/1998 Rogers et al. ..... 200/400

* cited by examiner

*Primary Examiner*—Michael A. Friedhofer
(74) *Attorney, Agent, or Firm*—James V. Lapacek

(57) ABSTRACT

A fault interrupter is provided that includes a high-speed disconnect in series with an interrupter wherein the circuit opening is via the interrupter and the circuit making is via the disconnect. A stored energy disconnect operating mechanism operates the disconnect between ground, open and closed positions and also charges the interrupter mechanism during a slow opening of the disconnect without fully charging the disconnect operating mechanism. Thus, the required operating forces to open the disconnect and charge the interrupter mechanism are reduced. During a manual opening, the disconnect operating mechanism trips open the interrupter, then only partially charges to begin opening the disconnect before releasing the stored energy. Continued operation of the disconnect operating mechanism slowly drives the disconnect open while charging the interrupter mechanism and closing the interrupter. The interrupter mechanism remains charged during operation of the disconnect between the open and ground positions by the disconnect operating mechanism.

11 Claims, 12 Drawing Sheets

FAULT INTERRUPTER AND OPERATING MECHANISM THEREFOR

BACKGROUND OF THE INVENTION

1. Field of the Invention

The present invention relates generally to a fault interrupter including a high-speed disconnect in series with an interrupter and more particularly to an arrangement wherein after the interrupter is tripped open, the interrupter mechanism is recharged and the interrupter is closed during a slow opening operation of the disconnect.

2. Description of Related Art

Various operating mechanisms for electrical switches and circuit interrupters provide multiple operational states at an output corresponding to the desired operational states of the switch controlled by the mechanism. For example, U.S. Pat. No. 5,504,293 and copending application Serial No. 08/713,938 filed in the names of E. W. Rogers et al. on Sep. 13, 1996 (now U.S. Pat. No. 5,772,009) disclose a useful compact operating mechanism that utilizes latch members that cooperate with an output lever to define three operating positions, the latch members functioning to stop and hold the output lever to define the operating positions. These arrangements operate a disconnect in series with an interrupter, the interrupter being tripped open before the disconnect is opened, and the interrupter mechanism being recharged during the closing operation as the disconnect mechanism is recharged and before the disconnect is closed.

An interrupter with disconnect is shown in U.S. Pat. Nos. 3,030,481 and 3,116,391. Upon opening operation, the interrupter is initially tripped open, then the disconnect is opened either by motor mechanism or manual drive, and the interrupter mechanism is charged during the blade opening.

A manual switch operator for operating a vacuum interrupter and a series connected disconnect between two operating positions is disclosed in U.S. Pat. 4,484,046. The arrangement on closing, closes the disconnect switch before the vacuum interrupter, and on opening, opens the vacuum interrupter before the disconnect. An additional solenoid switch operator is coupled to the interconnection provisions between the manual switch operator and the vacuum interrupter for opening the vacuum interrupter through solenoid action. While this arrangement may be useful, it does not provide a compact operating mechanism for sequencing the operation of an interrupter with a disconnect in three operating positions. Further, the arrangement includes expansive linkages and toggle joints which are not desirable, not only from a mechanical design standpoint but also from the perspective of minimizing the size of switchgear modules that house the operator and the electrical components.

U.S. Pat. No. 3,563,102 discloses a quick-make quick-break mechanism for operating a switch between open and closed positions. Other operating mechanisms are shown in the following U.S. Pat. Nos.: 3,845,433; 4,293,834; 5,140,117; and 5,224,590.

SUMMARY OF THE INVENTION

Accordingly, it is a principal object of the present invention to provide a fault interrupter having a high-speed disconnect in series with an interrupter and having a disconnect operating mechanism that is charged to close the disconnect but is not fully charged to open the disconnect thereby reducing the required operating forces while charging the interrupter mechanism and closing the interrupter during a slow opening of the disconnect.

It is another object of the present invention to provide an operating mechanism for a fault interrupter that includes a high-speed disconnect in series with an interrupter wherein during opening, the interrupter is tripped open, the disconnect is slowly opened and the interrupter mechanism is charged and the interrupter is closed during the opening of the disconnect, the operating mechanism operating the disconnect between ground, open and closed positions.

It is a further object of the present invention to provide a fault interrupter having a high-speed disconnect in series with an interrupter and having a stored energy disconnect operating mechanism that operates the disconnect between ground, open and closed positions and charges the interrupter mechanism and closes the interrupter during a slow opening of the disconnect without fully charging the disconnect operating mechanism, the interrupter mechanism remaining charged during operation of the disconnect between the open and ground positions by the disconnect operating mechanism.

These and other objects of the present invention are achieved by a fault interrupter having a high-speed disconnect in series with an interrupter wherein the circuit opening is via the interrupter and the circuit making is via the disconnect. A stored energy disconnect operating mechanism operates the disconnect between ground, open and closed positions and also charges the interrupter mechanism during a slow opening of the disconnect without fully charging the disconnect operating mechanism. Thus, the required operating forces to open the disconnect and charge the interrupter mechanism are reduced. During a manual opening, the disconnect operating mechanism trips open the interrupter, then only partially charges to begin opening the disconnect before releasing the stored energy. Continued operation of the disconnect operating mechanism slowly drives the disconnect open while charging the interrupter mechanism and closing the interrupter. The interrupter mechanism remains charged during operation of the disconnect between the open and ground positions by the disconnect operating mechanism.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 13:
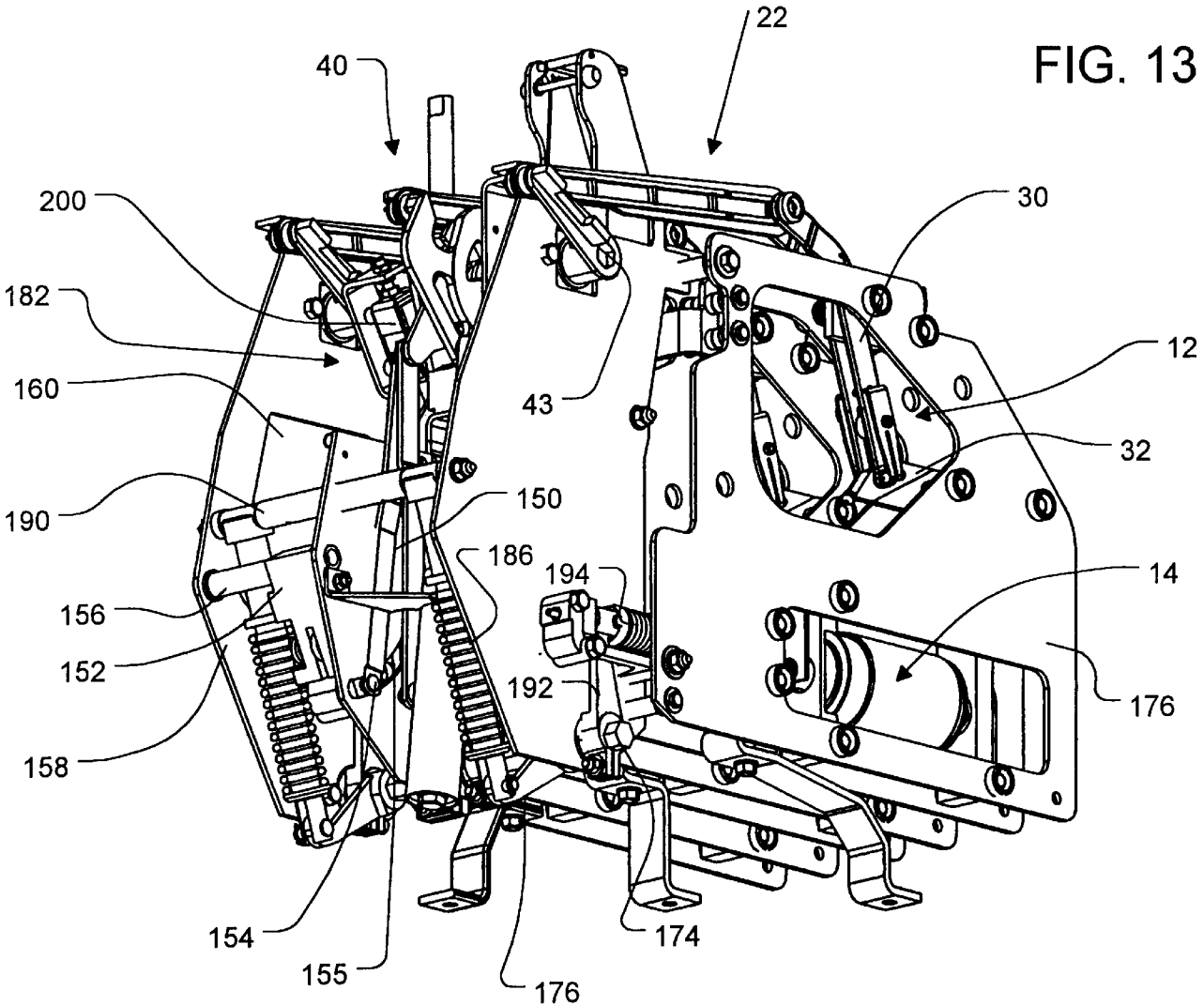
FIG. 13 is a perspective view of a multi-phase fault interrupter utilizing the disconnect operating mechanism of FIGS. 1–12.
Figure 14:
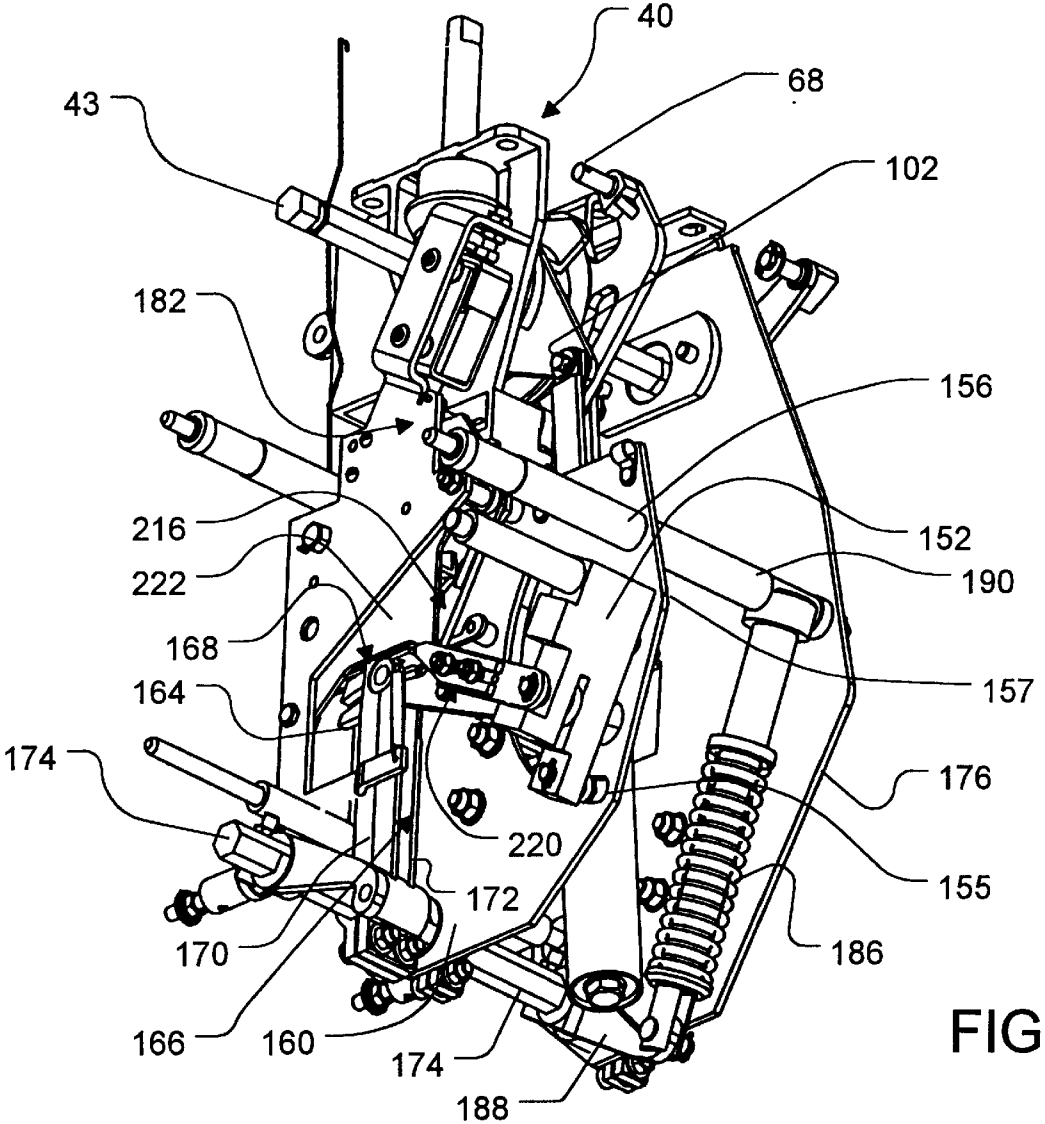
FIG. 14 is left perspective view of the multi-phase fault interrupter of FIG. 13 with parts removed for clarity.

Referring now to FIGS. 1 and 13–15, a multi-phase fault interrupter 10 in accordance with the present invention utilizes a disconnect 12 in series with an interrupter 14 for each phase, e.g. three as shown in FIG. 13. Circuit interruption occurs in the interrupter 14 followed by opening of the disconnect 12. Circuit making occurs via the high-speed closing of the disconnect 12, i.e. the interrupter 14 previously being closed. During opening, the interrupter 14 is tripped open and then the disconnect 12 is opened while also charging an interrupter mechanism 16 and closing the interrupter 14. During closing, a disconnect operating mechanism 40 is charged and then released to close the disconnect 12 at high speed, the interrupter 14 being capable of being tripped open at any point during the high-speed closing of the disconnect 12. The disconnect operating mechanism 40 is arranged to charge the interrupter mechanism 16 and close the interrupter 14 during an opening operation as will be explained in more detail hereinafter.

Figure 1:
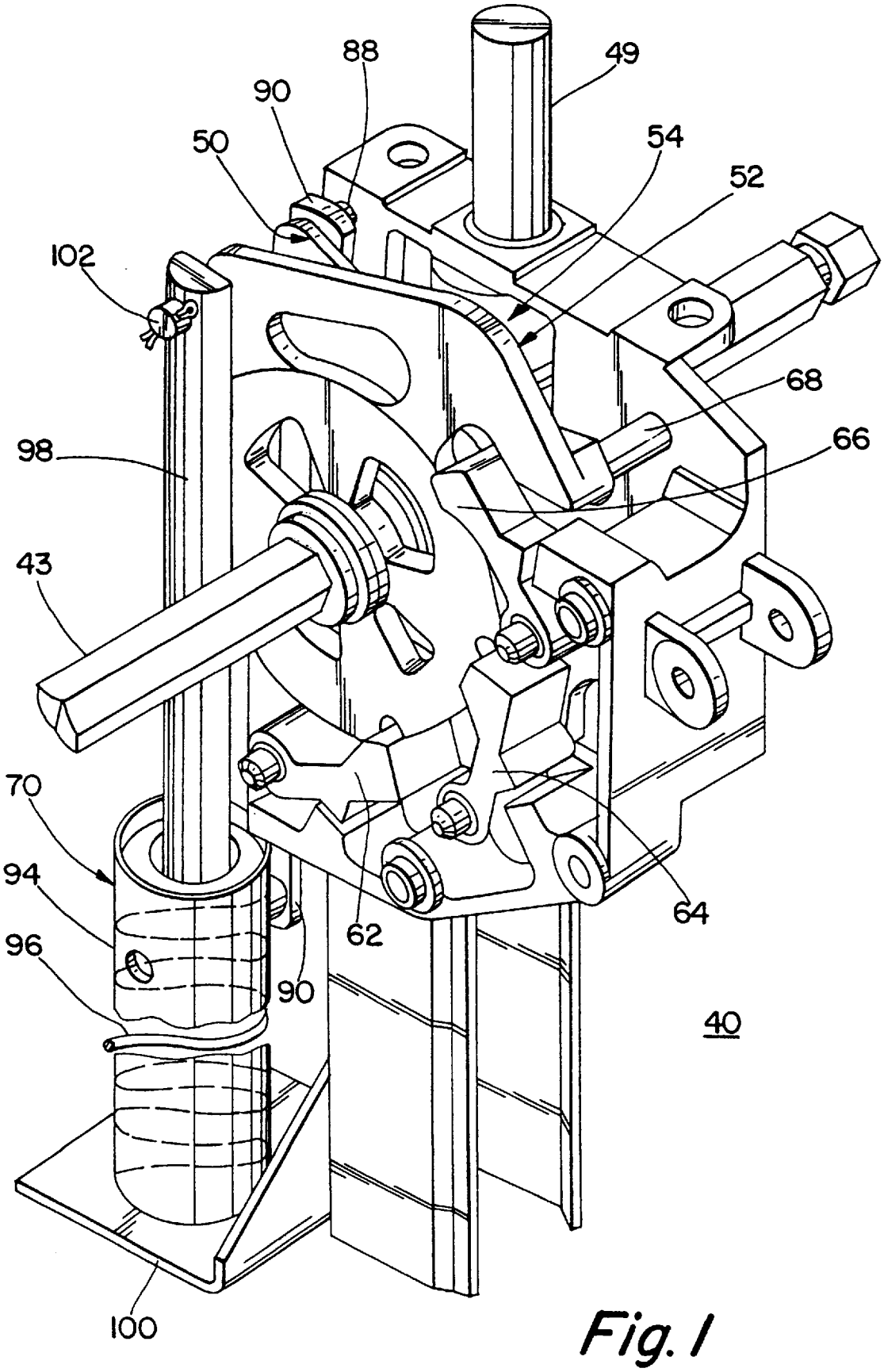
FIG. 1 is a perspective view of a disconnect operating mechanism in accordance with the principles of the present invention.

With specific reference now to FIG. 1 and with additional reference to FIGS. 2–12, the disconnect operating mechanism 40 is of the general type shown in U.S. Pat. No. 5,504,293 and copending application Ser. No. 08/713,938 (now U.S. Pat. No. 5,772,009) and is suitable for use to operate electrical components as disclosed in U.S. Pat. No. 5,521,567 and copending application Ser. Nos. 08/653,176 filed in the names of B. B. McGlone et al. on May 24, 1996 and 08/705,460 filed in the names of T. G. French et al. on Aug. 29, 1996 (now U.S. Pat. No. 5,864,107). In a specific illustrative embodiment, the disconnect operating mechanism 40 is operable between ground, open and closed operational positions, the disconnect operating mechanism 40 being shown in the ground position in FIGS. 1–3, and in the closed position in FIGS. 13–15.

The disconnect operating mechanism 40 includes a drive lever 50 and an output lever 52 which may also be referred to as a driven lever. The drive lever 50, which may also be referred to as a charging lever, is pivoted (rotated) via a gear drive arrangement 54 (best seen in FIG. 3) including a first bevel gear 56 that is rotatable by a charging/drive input 49 and a second bevel gear sector 58 fixed on the drive lever 50 and driven by the first bevel gear 56. The drive lever 50 also includes cam surfaces 60, 61 which are arranged to selectively contact and lift three latch levers 62, 64 and 66 during operation. The latch levers 62, 64 and 66 are pivotally mounted and circumferentially arranged around the mechanism 40 at the appropriate points in the pivotal movement of the drive lever 50 to achieve the desired operation of the mechanism 40, i.e. to release the output lever 52 to pivot (rotate) in response to the stored energy in a spring arrangement generally referred to at 70.

In accordance with important aspects of the present invention, the output lever 52 is stopped when moving between adjacent positions by cooperation between the output lever 52 and a respective one of the latch arms 62, 64, or 66, after the desired drive output rotation is obtained at an output shaft 43. The output shaft 43 is fixed to and rotates with the output lever 52. In this manner, the multiple operating positions are achieved. Further, in an illustrative arrangement, the output lever 52 includes an output pin at 68 for driving an output link 69 for actuating a disconnect 12, while the output shaft 43 is connected to drive additional disconnects 12 of the multi-phase interrupter 10 of FIG. 13 via a drive linkage referred to generally at 22.

Figure 3:
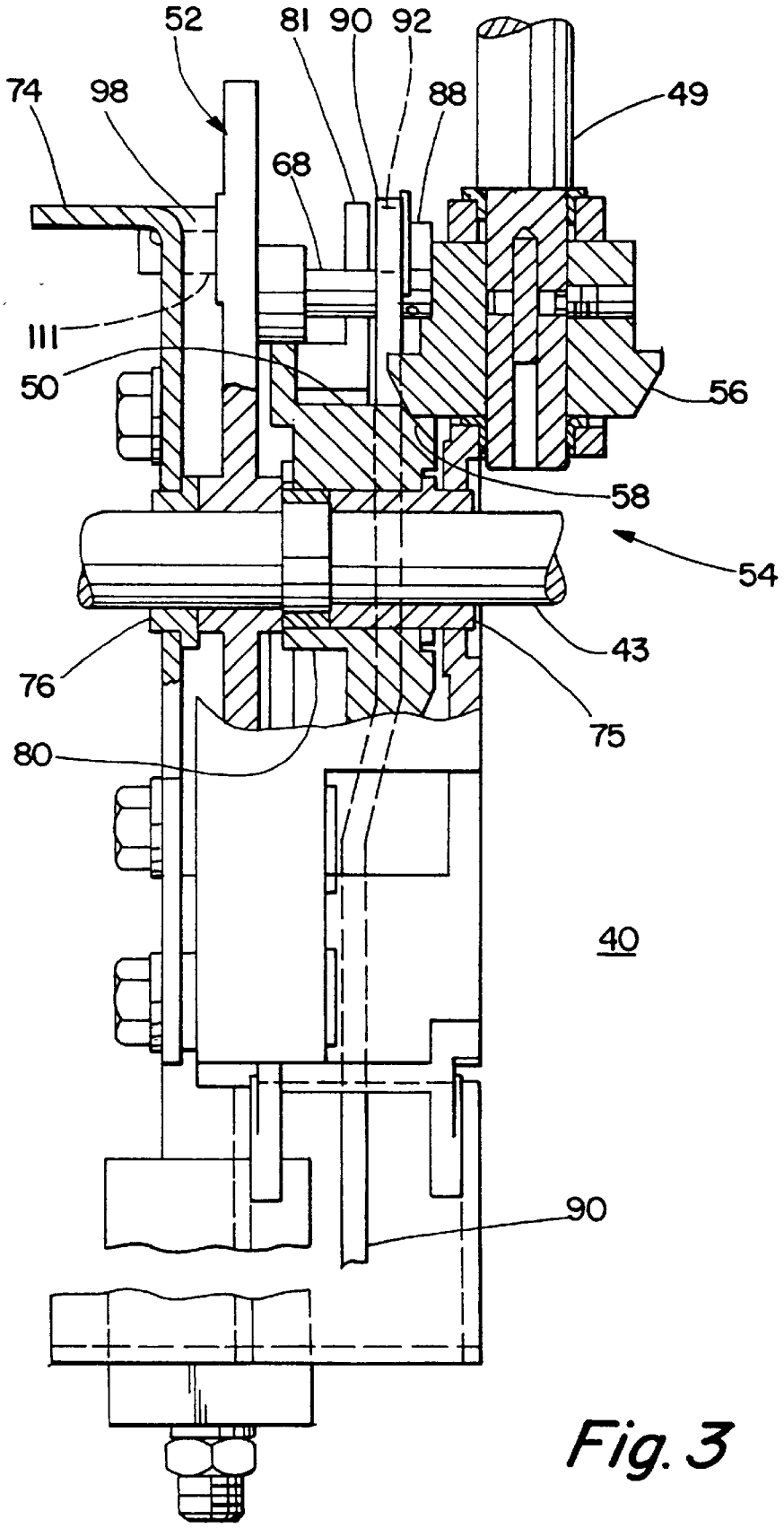
FIG. 3 is a right-side elevational view of FIG. 1, partly in section and with parts cut away for clarity.

The mechanism 40 includes a housing 72 and a cover portion 74. The output shaft 43 is pivotally mounted via a first bearing 75 on the housing 72 and a second bearing 76 on the cover portion 74 (removed for clarity in FIG. 1). The drive lever 50 is pivotally mounted with respect to the housing 72, e.g. as shown in FIG. 3, about the cylindrical outer surface 77 of the first bearing 75, the outer surface 77 functioning as a bearing surface.

Figure 4:
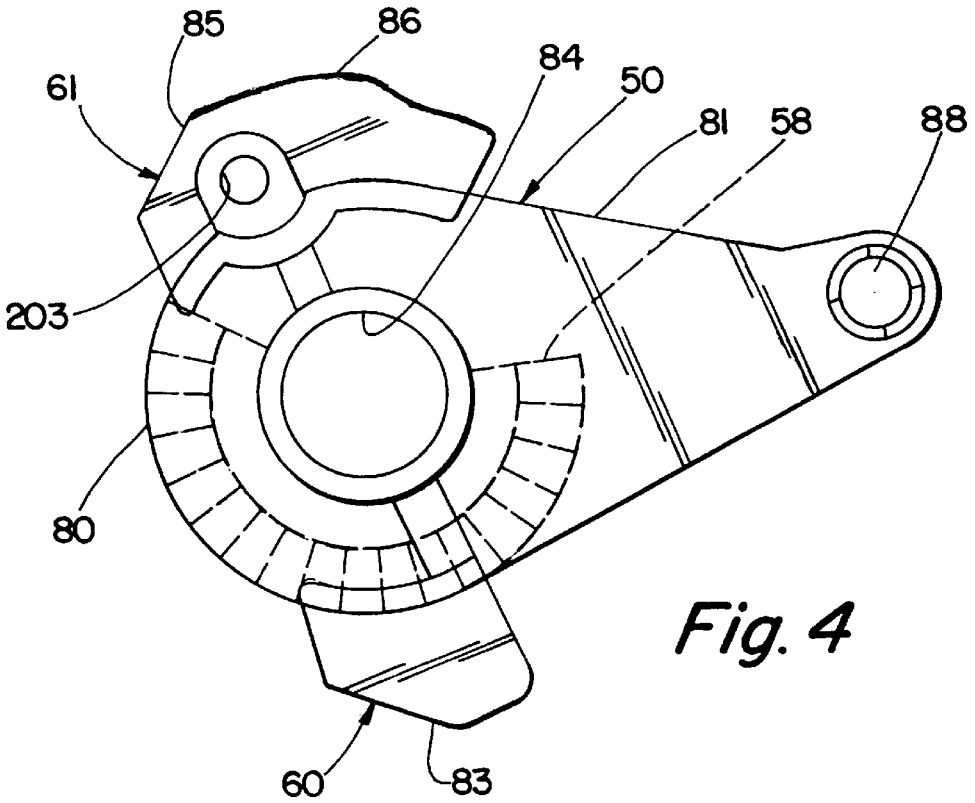
FIG. 4 is an elevational view of a drive lever of the disconnect operating mechanism of FIGS. 1–3.

Referring now additionally to FIG. 4, the drive lever 50 includes a central hub portion 80 with central aperture 84 and a radially extending arm 81. The two eccentric cam surfaces 60, 61 for operating the latch levers 62, 64 and 66 includes three latch kick-out portions 83, 85 and 86, the functioning of which will be explained in more detail hereinafter. The radially extending arm 81 includes a pin 88 (FIGS. 1, 3) which is arranged to drive a charging link 90 of the spring arrangement 70, e.g. via an aperture 92 in the charging link 90. The charging link 90 is arranged to drive a cylinder 94 of the spring arrangement 70. The spring arrangement 70 includes a spring 96 (referred to diagrammatically in FIG. 1) which is arranged between the cylinder 94 and an output rod 98. The cylinder 94 is slidably supported within a guide bracket 100 extending from the housing 72. The end of the output rod 98 is pivotally affixed to the output lever 52. When the charging link 90 is driven downwardly in FIGS. 1–3 via rotation of the drive lever 50 so as to drive the cylinder 94 downward, the spring 96 of the spring arrangement 70 is charged.

Figure 5:
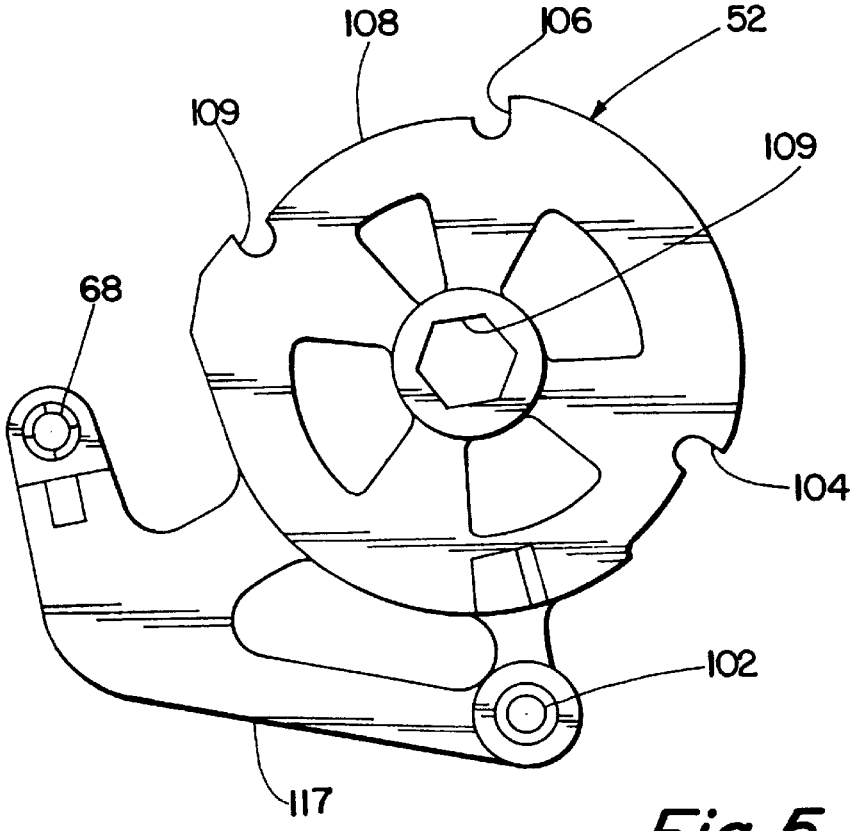
FIG. 5 is an elevational view of an output lever of the disconnect operating mechanism of FIGS. 1–3.
Figure 9:
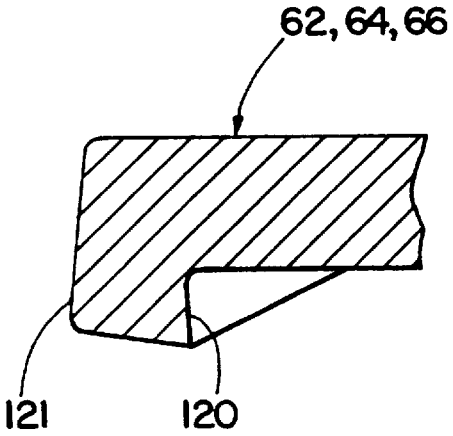
FIG. 9 is a partial sectional view on an enlarged scale taken along the line 9—9 of FIG. 7.
Figure 7:
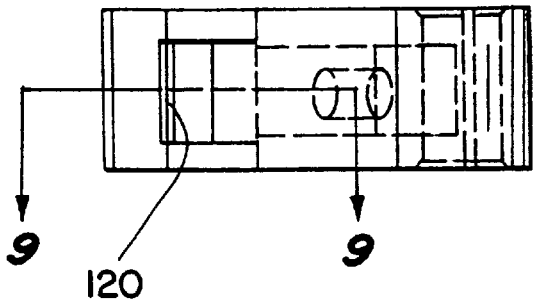
FIGS. 6–8 are respective front elevational, bottom plan, and left-side elevational views of a latch member of the disconnect operating mechanism of FIGS. 1–3.
Figure 8:
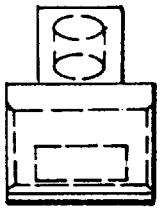
Figure 6:
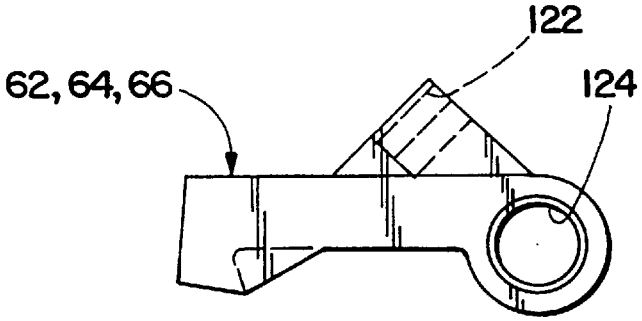

Referring now additionally to FIG. 5, the output lever 52 includes a drive pin 102 pivotally affixed to the output rod 98, e.g. the pin 102 extending through an aperture 111 of the output rod 98. As best seen in FIG. 5, the output lever 52 has a generally circular periphery 108 and includes a central aperture 109 for receiving the output shaft 43. The pins 68 and 102 are provided on a radially extending portion 117 of the output lever 52. Circumferentially arranged at predetermined locations along the periphery 108 of the output lever 52 are three shoulders 104, 106 and 107 which function as latch impact stops and also function separately as anti-reverse motion holding stops. The three shoulders 104, 106 and 107 divide the output lever 52 into areas of higher and lower radii.

Figure 2:
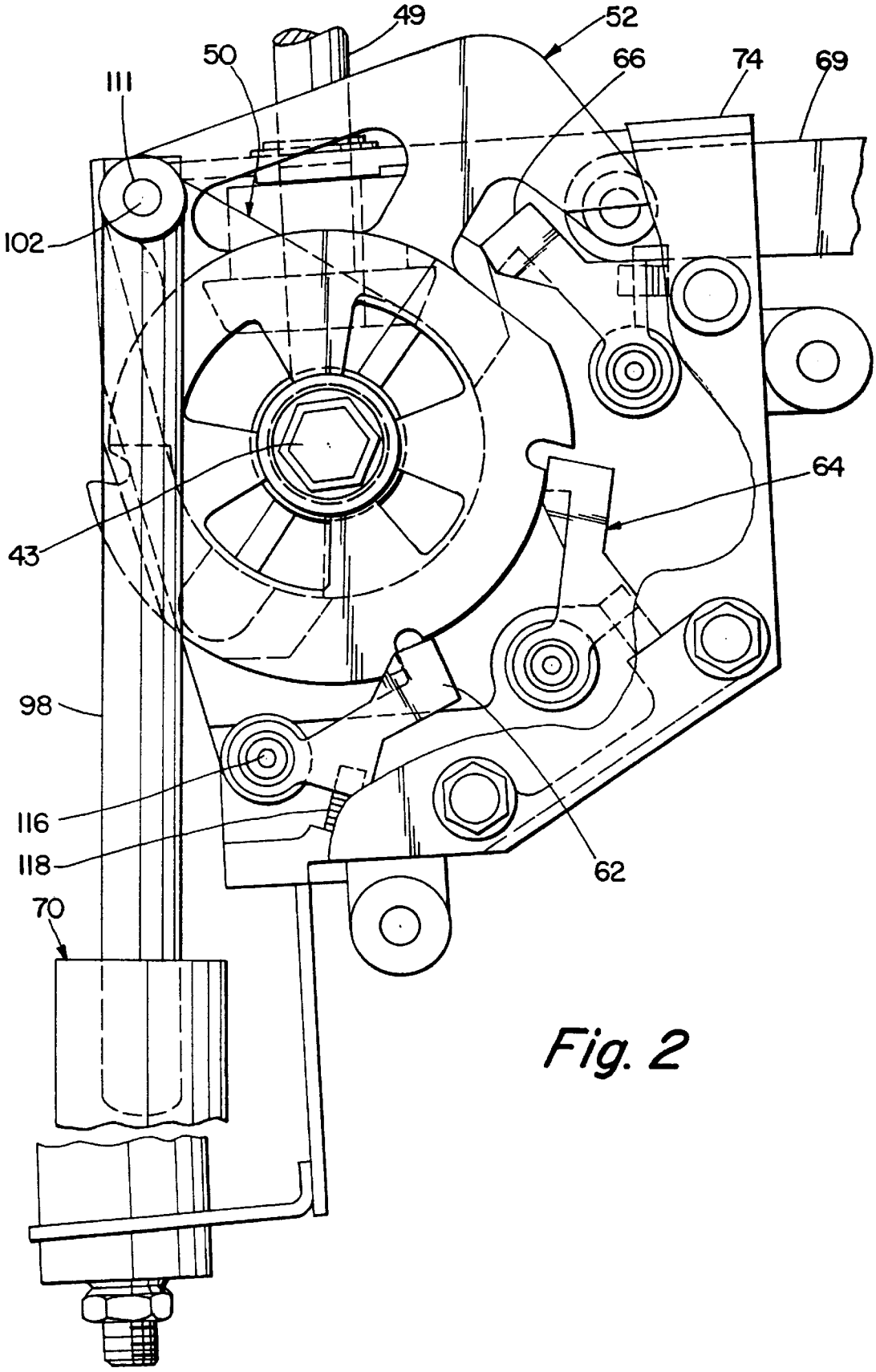
FIG. 2 is a front elevational view of the disconnect operating mechanism of FIG. 1 with parts cut away and removed for clarity.

The latch arms 62, 64 and 66 are pivotally mounted with respect to the housing 72 and are biased radially inward toward the output lever 52 by springs, e.g. as shown in FIG. 2, latch member 62 is pivotally mounted at 116 and biased by a spring 118. Referring now additionally to FIGS. 6–9, the latch members 62, 64 and 66 include latch surfaces 120 and 121, each of the latch surfaces 120, 121 being utilized for different directions of relative movement of the output lever 52 with respect to the latch members 62, 64 and 66. Further, the latch members 62, 64 and 66 include passages 122 for receiving the biasing springs, e.g. 118, and apertures 124 for the pivotal mounting at 116.

During operation, when the drive lever 50 is pivoted counterclockwise in FIGS. 1 and 2 via the charging/driving input at 49 (i.e. from the ground position to the open position), the arm 81 of the drive lever 50 drives the charging link 94 to charge the spring arrangement 70 while the output lever 52 is held by the latch member 62 in the ground position. When the drive lever 50 is pivoted far enough such that the cam surface 85 lifts the latch member 62, the output lever 52 is released to pivot counterclockwise in response to the release of stored energy in the compressed spring 96 of the arrangement 70. When driven into the open position, the output lever 50 impacts on and is stopped from further pivoting by means of the latch member 64 acting against the shoulder 106 of the output lever 52.

In the open position, when the drive lever 50 is again pivoted counterclockwise, the cam surface 85 of the drive lever 50 lifts the latch member 64 and the output lever 52 is driven into the closed position whereat the latch member 66 impacts on and the output lever 52 is stopped by means of the shoulder 106 of the output lever 52.

Figure 12:
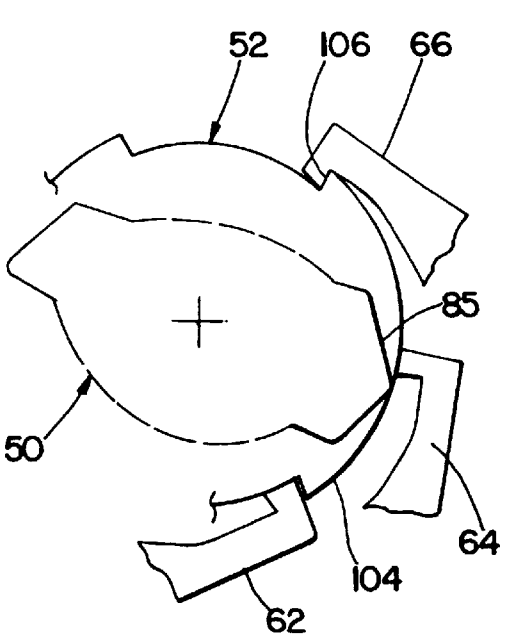
FIGS. 10–12 are diagrammatic representations of the drive lever, output lever, and latch members of the disconnect operating mechanism of FIGS. 1–9 illustrating three respective operating positions.
Figure 11:
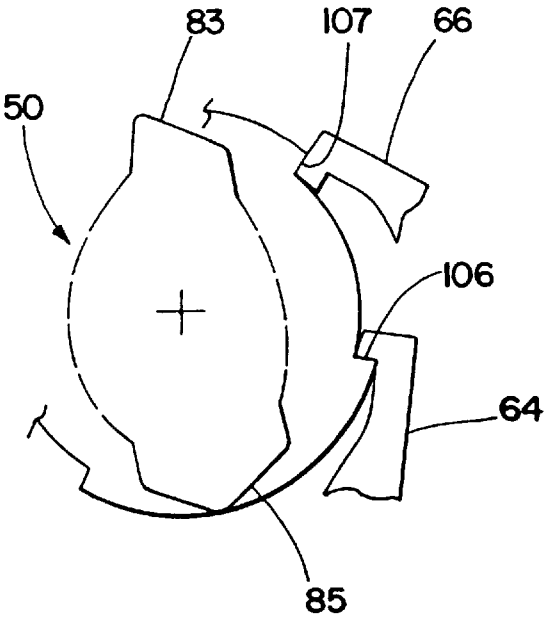
Figure 10:
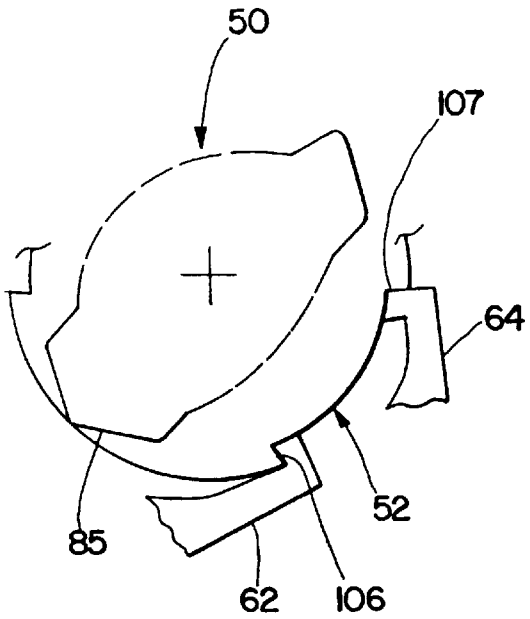

Referring now additionally to FIGS. 10–12, the positions of the drive lever 50, the output lever 52 and the latch members 62, 64 and 66 are illustrated for the respective operating positions, i.e. the ground position in FIG. 10, the open position in FIG. 11, and the closed position in FIG. 12. In accordance with important aspects of the present invention, the latch members 62, 64 and 66 in combination with the shoulders 107 and 104 also provide holding against anti-reversing in the ground, open and closed operational positions of FIGS. 10–12. For example, in the ground position of FIG. 10, the latch member 64 holds against the shoulder 107 of the output lever 52 which holds the output lever 52 against clockwise movement. Similarly, in the open position of FIG. 11, the latch member 66 holds against the shoulder 107 to prevent reverse (clockwise) movement. In the closed position of FIG. 12, the latch member 62 holds against the shoulder 104 to prevent reverse movement.

Figure 19:
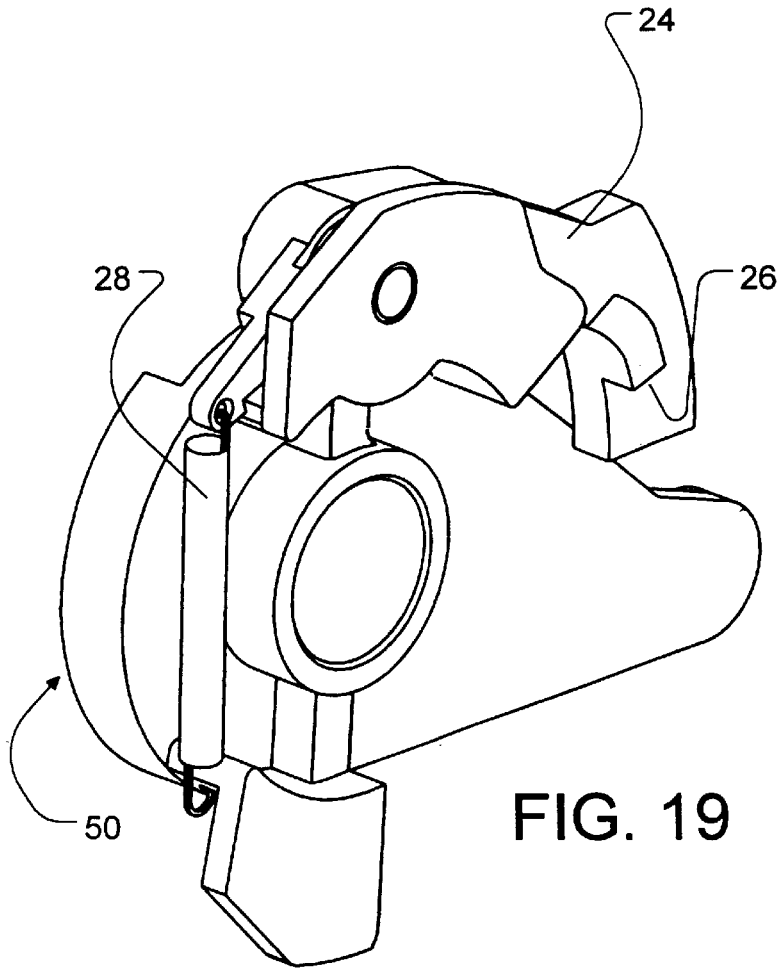
FIG. 19 is a perspective view of the drive lever of FIG. 4 additionally illustrating a pryout feature.

Considering now operation of the drive lever 50 in the clockwise direction in FIGS. 1 and 2, i.e. driving the output lever 52 from the closed position of FIG. 12 to the open position of FIG. 11, as the drive lever 50 initially begins to move clockwise, the interrupter mechanism 16 is tripped and the interrupters 14 are opened. With continued rotation of the drive lever 50, the spring 70 is partially charged until the cam surface 86 of the drive lever 50 lifts the latch member 62, which releases the output lever 52. The partially charged spring 70 then acts to pivot the output lever 52 to begin opening the disconnects 12 which include contacts 30, 32 (see FIG. 15). With additional reference to FIG. 19, in the event the contacts 30, 32 of the disconnects 12 are not easily separable, e.g. being stuck or "welded", a pryout pawl 24 is provided and includes an extending portion 26 that acts against the drive output lever 52 during this portion of the disconnect opening. The pryout pawl 24 acting against the drive output lever 52 provides a force to separate the contacts 30, 32 of the disconnects 12. After a predetermined amount of rotation of the drive lever 50, the pryout pawl 24 disengages the output lever 52 and moves out of engagement therefrom. The pryout pawl 24 is pivotally carried by the drive lever 50 and biased via an expansion spring 28. With continued rotation of the drive lever 50 toward the open position of FIG. 11, the output lever 52 is driven through the spring 70 so as to slowly open the disconnects 12. Additionally, during this further rotation toward the open position, as the disconnects 12 are opening, the interrupter mechanism 16 is charged and latched and the interrupters 14 are closed. In the open position of FIG. 11, the holding latch member is now latch member 62 which prevents clockwise movement of the output lever 52 and the latch member 66 is the anti-reverse movement preventing latch member.

In the open position of FIG. 11, with clockwise rotation of the drive member 50 to move the disconnect operating mechanism 40 into the ground position, the drive lever 50 via cam surface 83 lifts the latch member 66 whereupon the output lever 52 moves clockwise until the latch member 64 impacts against the shoulder 107.

Accordingly, from the foregoing discussion, it can be seen that the disconnect operating mechanism 40 in the open position of FIG. 11 can be operated to either the closed position of FIG. 12 or the ground position of FIG. 10 dependent upon the direction of rotation of the charging/driving input 49 and thus the drive lever 50. For operation into the closed position, the interrupters 14 can be tripped as necessary, e.g. when closing into a fault condition, in which case, the interrupter mechanism 16 is tripped to open the interrupters 14.

Referring now to FIGS. 13–18, and considering now the interrupter mechanism 16 and the disconnect operating mechanism 40 of the multi-phase fault interrupter 10 in more detail, the disconnect operating mechanism 40 is arranged to charge the interrupter mechanism 16 via a connecting link (pull rod) 150 that is connected at the output pin 102 of the disconnect operating mechanism 40 and arranged to drive a first toggle link 152 of the interrupter mechanism 16 at a pin 154. The first toggle link 152 is pivotally mounted on a shaft 156 carried by two support sheets 158, 160. The pin 154 is arranged to move in an arcuate slot 155 of a support plate 157. A second toggle link 162 is pivotally carried by the first toggle link 152 and includes a bifurcated end 164 that is arranged to drive a charging lever 166 via a pin 168 that spans the spaced apart arms 170, 172 of the charging lever 166. The charging lever 166 is fixedly carried by an operating shaft 174 that is pivotally mounted with respect to support sheets 158 and 176. The upper end 178 of the charging lever 166 carries a roller 180 (FIG. 16) which is selectively retained by a latch arrangement 182. Two compression springs 184, 186 are pivotally carried at one end with respect to the operating shaft 174 by drive levers 188. The other end of the springs 184, 186 are affixed to a support shaft 190 that is pivotally carried by the support sheets 158 and 176. When the drive lever 50 rotates counterclockwise in FIG. 14, the operating shaft 174 is rotated counterclockwise via the pivoting of the charging lever 166 by the first and second toggle links 152 and 162. The counterclockwise rotation of the operating shaft 174 charges the springs 184, 186 of the interrupter mechanism 16.

Figure 15:
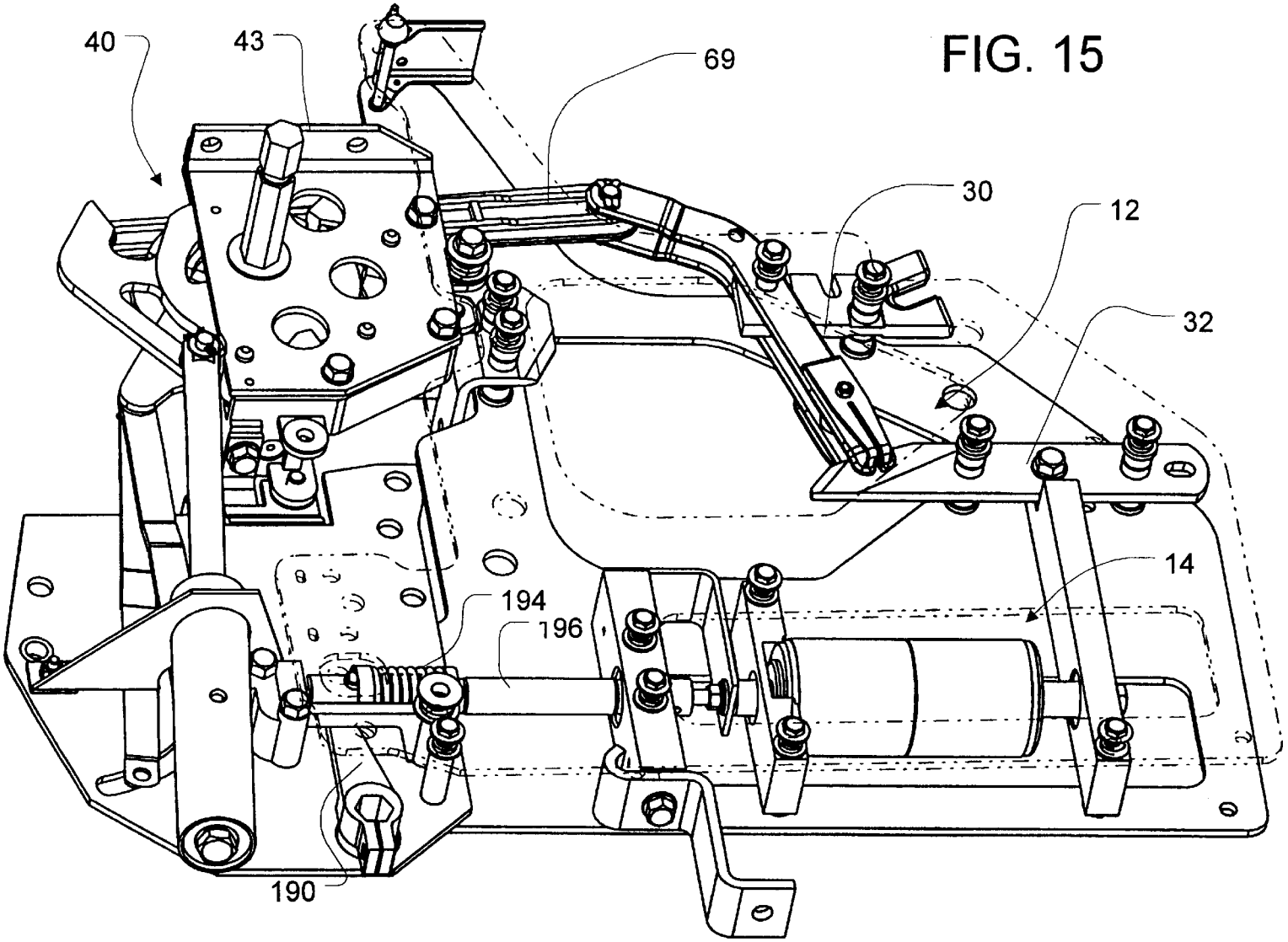
FIG. 15 is a perspective view of the multi-phase fault interrupter of FIG. 13 with parts removed to illustrate a middle phase.
Figure 16:
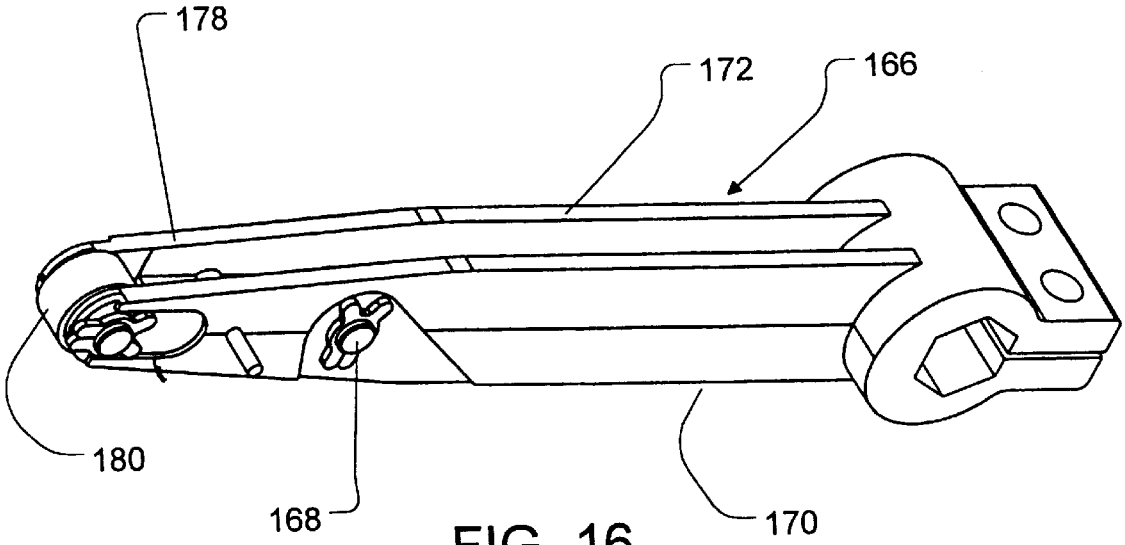
FIG. 16 is a perspective view of a charging lever of an interrupting mechanism of the multi-phase fault interrupter of FIGS. 13–15.

After the interrupter mechanism 16 is charged, the latch arrangement 182 is engaged to latch the interrupter mechanism 16 after the disconnect operating mechanism 40 has latched in the open position as discussed hereinbefore. When the latch arrangement 182 is tripped, the charging lever 166 is released whereupon the operating shaft 174 rotates clockwise as the compression springs 184, 186 are released. As best seen in FIGS. 13 and 15, rotation of the operating shaft 174 moves the interrupters 14 between the open and closed positions. Specifically, operating levers 192 are fixedly carried by the operating shaft 174 and arranged to operate the interrupters 14 through contact springs 194 and dielectric operating rods 196. As discussed previously, when the disconnect operating mechanism 40 is initially moved out of the closed position and toward the open position, the latch arrangement 182 is tripped to release the interrupter mechanism 16 and open the interrupters 14. After the disconnects 12 begin to open, the interrupter mechanism 16 is charged as discussed hereinabove. When the disconnect operating mechanism 16 is moved out of the open position and toward the closed position, the interrupter mechanism 16 remains charged and the interrupters 14 remain closed ready to operate.

Figure 17:
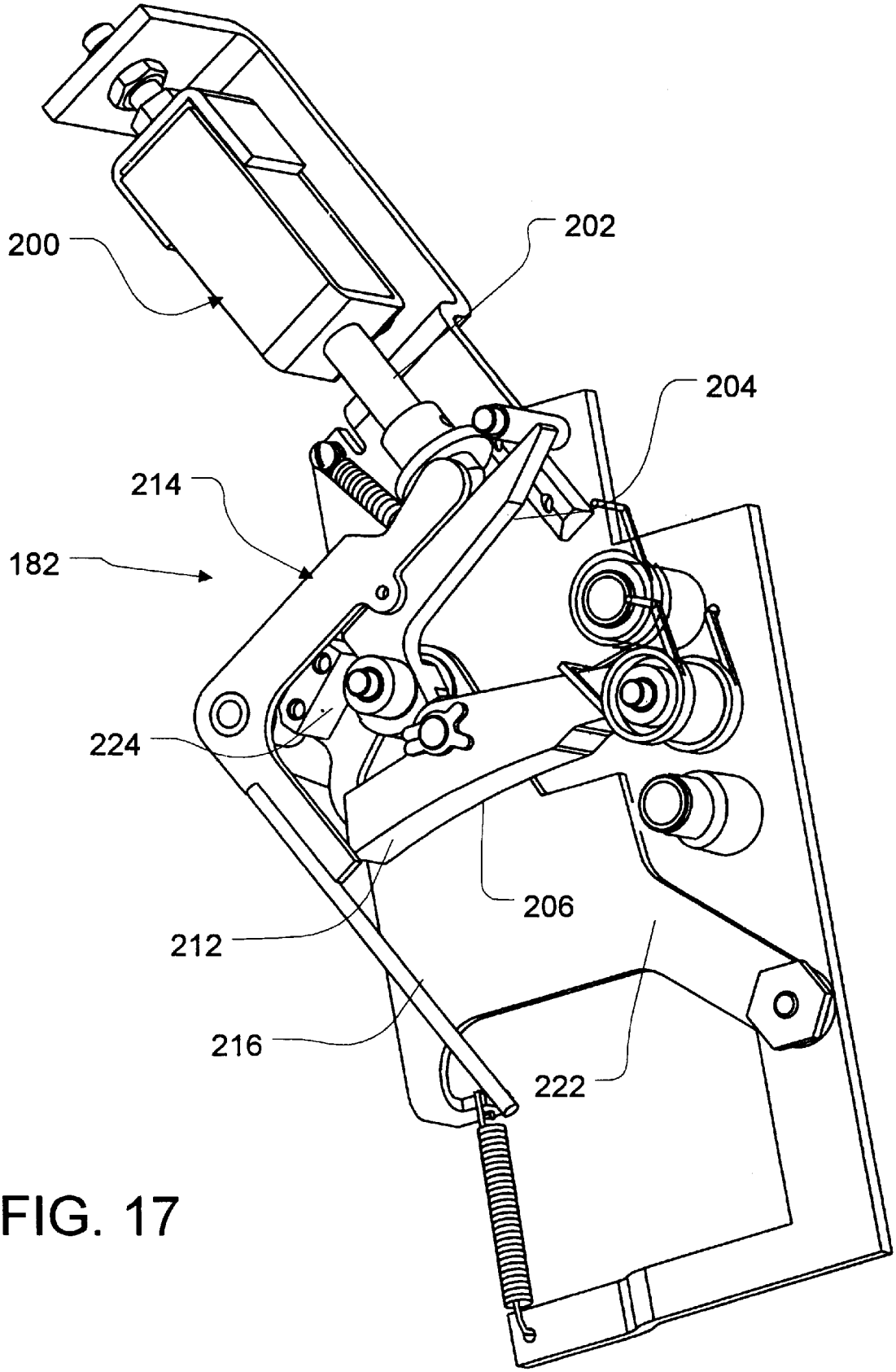
FIGS. 17 and 18 are respective perspective and front elevational views of a latch arrangement of the interrupting mechanism of the multi-phase fault interrupter of FIG. 13 shown in a latched position.
Figure 18:
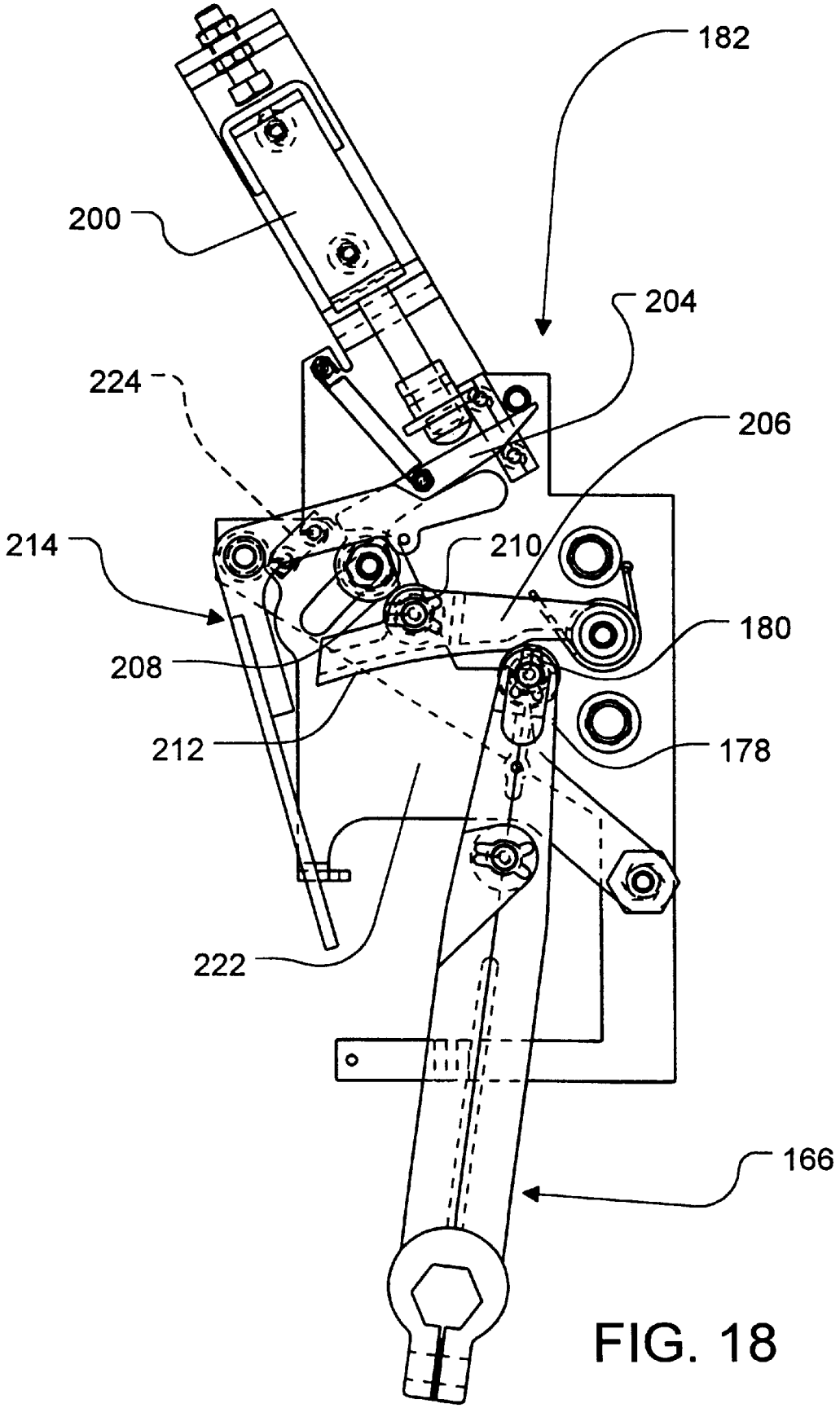

The latch arrangement 182 (the details of which are best seen in FIGS. 17–18) includes provisions to trip the interrupters 14 open in either a manual mode or in response to a detected fault condition, either in the closed position or during closing, via a trip signal that actuates a solenoid 200. Considering first an opening operation of the interrupters 14 responsive to the detection of a fault, the solenoid 200 is operated so as to rapidly move a plunger 202 of the solenoid 200 downwardly which contacts and pivots a secondary latch member 204 clockwise which releases a primary latch member 206 to pivot clockwise. The roller 180 of the charging lever 166 is released to permit the discharge of the interrupting mechanism 16, as explained hereinbefore, and the opening of the interrupters 14. The secondary latch member 204 includes a cam surface at 208 that is arranged to release a roller 210 of the primary latch member 206 when the secondary latch member 204 pivots. The primary latch member 206 also includes an arcuate surface at 212 which is arranged to coact with the roller 180 (FIG. 18) of the charge lever 166. The solenoid plunger 202 is reset to its upper position as shown in by a pivotally mounted reset lever 214 which is operated during the closing operation of the disconnect operating mechanism 40 via an extending rod portion 216 (also seen in FIG. 14). The extending rod portion 216 of the reset lever 214 is affixed to the second toggle link 162. The reset lever 214 also blocks any inadvertent operation of the solenoid plunger 202 during the opening operation and in the open and ground positions of the disconnect operating mechanism 40.

Considering a manual opening operation of the interrupters 14 during an opening operation of the disconnect operating mechanism 40, as the first toggle link 154 begins to pivot, a trip lever 220 extending from the toggle link 154 contacts and pivots a movably mounted trip slide member 222 which extends upwardly and includes an operating surface at 224 which is arranged to contact and pivot the secondary latch member 204, with operation proceeding as described hereinabove.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A fault interrupter comprising:

disconnect means movable at least between open and closed positions;

interrupter means connected in series with said disconnect means and being operable between open and closed positions; and operating means for controlling said disconnect means and said interrupter means between said open and closed positions, said operating means including a drive input, means responsive to said drive input for storing operating energy comprising first means for operating said disconnect means and second means for operating said interrupter means, said second means being charged as said disconnect means is opened, said first means being charged as said drive input is moved from an open position toward a closed position and discharged to open said disconnect means, said second means being discharged as said drive input is moved out of said closed position and toward said open position.

2. The fault interrupter of claim 1 wherein said disconnect means is opened after said interrupter means.

3. The fault interrupter of claim 1 further comprising interrupter tripping means responsive to an input signal for discharging said second means to open said interrupter means.

4. The fault interrupter of claim 1 wherein said disconnect means is also movable to a ground position, said first means comprising means for operating said disconnect means between said open and ground positions.

5. The fault interrupter of claim 1 wherein said second means remains charged when said disconnect means moves between said open and closed positions.

6. The fault interrupter of claim 1 wherein said first means comprises means responsive to said drive input being moved from said closed position to said open position for opening said disconnect means without said first means being fully charged.

7. The fault interrupter of claim 1 wherein said first means comprises means responsive to said drive input being moved from said closed position to said open position for moving said disconnect means into said open position without being discharged.

8. The fault interrupter of claim 7 wherein said first means further comprises energy storage means and means for applying an opening force to said disconnect means independently of said energy storage means.

9. The fault interrupter of claim 7 wherein said operating means further comprises output member means movably mounted and arranged to be driven by said first means and third means for stopping, latching and selectively releasing said output member means and defining predetermined operating positions for said output member means, said third means comprising movable latch members that are biased in a predetermined manner with respect to said output member means and stop means on said output member means for defining with said movable latch members said predetermined operating positions, said third means further comprising means for selectively releasing said movable latch members at predetermined positions of said first means whereby said output member means is released for movement upon each of said movable latch members being selectively released.

10. The fault interrupter of claim 9 wherein said first means comprises a drive member having a periphery defining a plurality of cam surfaces which are arranged to selectively release said movable latch members at predetermined respective positions of said drive member.

11. An operating mechanism for a fault interrupter that includes a high-speed disconnect in series with an interrupter wherein a circuit opening function is via the interrupter and a circuit making function is via the disconnect, the disconnect being movable between an open and a closed position, the interrupter being operable between an open circuit position and a closed circuit position, the operating mechanism comprising energy storage means capable of being charged and storing energy for operating the disconnect and the interrupter, the operating mechanism further comprising operating means operable between open and closed operating positions for charging said energy storage means with disconnect operating energy and discharging said energy storage means to rapidly move the disconnect from the open position to the closed position, with the interrupter in the open circuit position said operating means comprising means responsive to said operating means being operated from said closed operating position toward said open operating position to move the disconnect from the closed position toward the open position without discharging said energy storage means and while charging said energy storage means with interrupter operating energy to operate the interrupter to the closed circuit position, said energy storage means remaining charged in the closed operating position whereby the interrupter is maintained in the closed circuit position with the interrupter being capable of being operated to the open circuit position.

* * * * *